US006875093B2

(12) United States Patent
Friel, Sr. et al.

(10) Patent No.: US 6,875,093 B2
(45) Date of Patent: Apr. 5, 2005

(54) SHARPENING DEVICE

(75) Inventors: Daniel D. Friel, Sr., Greenville, DE (US); Daniel D. Friel, Jr., Kennett Square, PA (US); Terry J. Hall, Sr., Wilmington, DE (US)

(73) Assignee: Edgecraft Corporation, Avondale, PA (US)

( * ) Notice: Subject to any disclaimer, the term of this patent is extended or adjusted under 35 U.S.C. 154(b) by 0 days.

(21) Appl. No.: 10/686,133

(22) Filed: Oct. 14, 2003

(65) Prior Publication Data

US 2004/0077296 A1 Apr. 22, 2004

Related U.S. Application Data

(60) Provisional application No. 60/418,475, filed on Oct. 15, 2002.

(51) Int. Cl.[7] ..... B24B 7/00

(52) U.S. Cl. ..... 451/260; 451/261; 451/266; 451/293; 451/349; 451/359

(58) Field of Search ..... 451/260, 261, 451/266, 293, 349, 359

(56) References Cited

U.S. PATENT DOCUMENTS 4,627,194 A * 12/1986 Friel ..... 451/163
4,716,689 A * 1/1988 Friel ..... 451/45
4,807,399 A * 2/1989 Friel ..... 451/45
4,897,965 A * 2/1990 Friel ..... 451/282
5,148,634 A * 9/1992 Bigliano et al. ..... 451/282
5,245,789 A * 9/1993 Rees et al. ..... 451/198
5,390,431 A * 2/1995 Friel ..... 451/45
5,582,535 A * 12/1996 Friel ..... 451/45
5,620,359 A * 4/1997 Harrison et al. ..... 451/45
6,012,971 A 1/2000 Friel, Sr. et al.
6,071,181 A * 6/2000 Wightman et al. ..... 451/192
6,113,476 A * 9/2000 Friel et al. ..... 451/177
6,709,320 B2 * 3/2004 Li ..... 451/349

OTHER PUBLICATIONS

Grit Size Comparison Chart, http://www.cs.rochester.edu/roche/rec.wood.misc/grit.sizes.*

* cited by examiner

*Primary Examiner*—M. Rachuba

(57) ABSTRACT

A sharpener includes a motor driven shaft with at least one slidably mounted sharpening assembly consisting of a supporting hub structure mounted by its central bore hole on the shaft. The hub structure supports a symmetrically shaped rotating surface containing an ultra fine abrasive material. The rotating surface is pressed with a force of less than 0.2 lb. by a spring action to make sustained rotating abrading contact with a facet of a knife positioned by a knife guide to align the facet into contact with the surface containing the abrasive materials.

22 Claims, 4 Drawing Sheets

SHARPENING DEVICE

CROSS REFERENCE TO RELATED APPLICATION

This application is based upon provisional application Ser. No. 60/418,475, filed Oct. 15, 2002.

FIELD OF INVENTION

This invention relates to an improved power driven sharpening apparatus for knife edges and edges of metal cutting tools.

BACKGROUND OF INVENTION

There have been a wide range of devices and mechanisms for sharpening the edge of knives and cutting tools both manual and power driven. A number of these have been the subject of patents by this inventor including U.S. Pat. Nos. 4,627,194, 4,716,689, 4,807,399, 4,897,965, 6,113,476, and 6,012,971. These describe sharpeners capable of creating very sharp edges. The perfection and effectiveness of the final edge is in each case limited by the design of the final sharpening stage.

SUMMARY OF INVENTION

The invention relates to an improved design of a powered finishing stage that creates an exceedingly sharp and effective edge by minimizing the size of the burr resulting from the abrading actions during the metal removal process. The invention involves novel means that make it possible to use effectively abrasives of exceedingly small grit size in the finishing stage of powered sharpeners.

The process of sharpening a cutting edge commonly involves a series of abrading steps. First the faces of the knife immediately adjacent to the edge must be beveled on each side of the cutting edge by removing material at some selected angle $\alpha$ relative to the center plane of the blade faces. Most knives are made of metal. As metal is removed on each face at the selected angle $\alpha$, facets are formed along the edge of the blade which intersect each other at the edge at a total angle of 2 $\alpha$. As these facets are created, the material removal process along the last-to-be-created (abraded) facet creates along the edge a burr which is bent away from the abrading mechanism in the direction of the adjacent facet as shown in FIG. 1. The creation of the burr results from the fact that the very thin edge being created by the intersection of the facets is unsupported and too thin to physically resist the force being applied by the abrading process. Hence the edge being formed bends away from the abrasive action. The force needed to abrade exceeds the force necessary to bend the edge away from the abrasive. Hence as the abrading force increases the burr becomes larger. Conversely if the abrading force can be reduced the size of the burr will be reduced. Old fashioned power driven sharpening stones that were rigidly mounted on a motor shaft resulted in extremely high forces being applied to the knife edge facets which overheated and gouged the edge and left large burrs and the blade consequently was relatively dull.

The presence of a burr along a cutting edge, reduces greatly the cutting ability of the edge. Consequently it is important to reduce the size of the resulting burr and to reduce the curvature of the burr by altering the sharpening process in a manner that minimizes and limits the force being applied to the blade facets when sharpening.

When metal blades are sharpened by conventional abrading process a burr is virtually always formed along the edge.

If more efficient abrasives such as diamonds are used, the magnitude of abrading force that must be applied normal to the facet is reduced as compared to the force necessary to abrade the same amount of metal in unit time from the facet by less effective abrasives such as silicon oxide or silicon carbide. Because the force necessary to abrade is reduced by using more efficient abrasives, the size of the burr can be reduced.

Consequently to reduce the size and extension of the burr one should use an efficient abrasive material, a smaller effective particle size of the grit and apply the lightest possible force normal to the facets during the final abrasive sharpening process before the edge is used for cutting. If a burr of any size remains along the edge, it will be bent over by the forces of cutting with the blade. The larger the burr the easier it can be bent over and folded back against the adjacent edge facet impairing sooner the cutting effectiveness of the edge.

Because of these factors it is important in the finishing step of sharpening to use an exceedingly fine grit but effective abrasive and a very low abrading force normal to the facets. Previous attempts to use lower abrading forces in powered sharpeners have been unsuccessful due to serious mechanical problems that limit the attainable sharpness, damage the edge and destroy the symmetry of the abrasive surface.

The geometry of the finishing apparatus can take many forms, however, this inventor has developed a novel, highly effective, low-cost combination of motor driven disks coated with ultra-fine diamonds where the abrasive coated disks are held by an exceedingly low-force spring action against a positioning stop on a motor driven shaft. The positioning stop serves to locate the surface of the abrasive coated disks immediately adjacent to knife guides positioned and angled so that the edge facets of the knife blades being sharpened contact the abrasive surface of the motor driven rotating spring-loaded disks and displace the disks against the low-force spring while maintaining contact with the abrasive surface of the rotating disk. Consequently the sharpening of the blade facets occurs at a rate controlled and limited by the force of the springs. As the spring force is reduced the size of the resulting burr at the edge of the blade is reduced.

THE DRAWINGS

DETAILED DESCRIPTION

Figure 4:
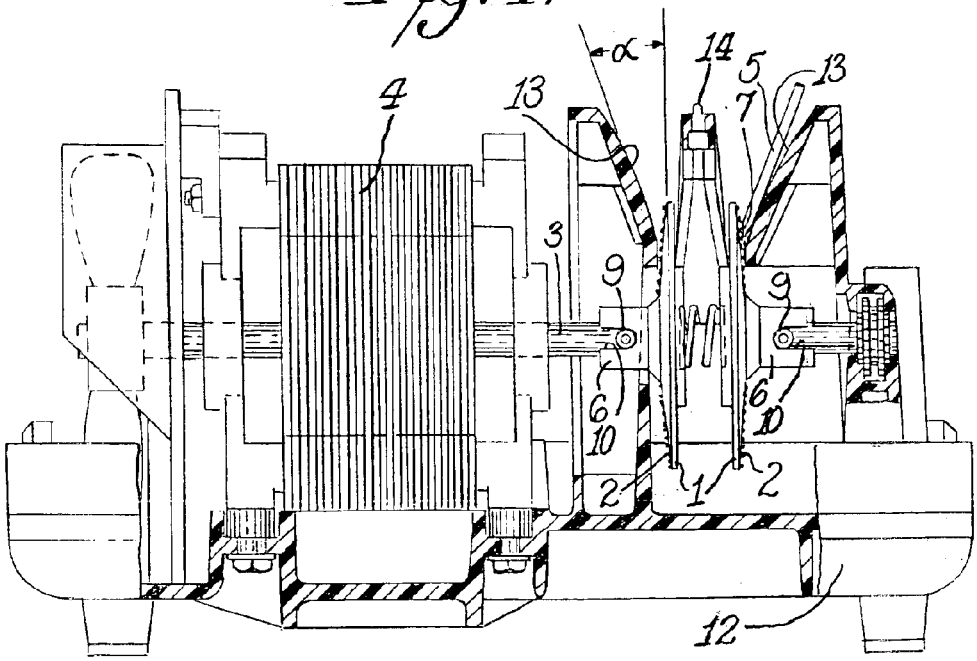
FIG. 4 is a view partly in section of the sharpener shown in FIG. 3.

One physical arrangement for a sharpener that has proved effective for sharpening with ultra fine abrasives is shown by way of example in FIG. 4 in cut-away form. Two sharpening disks 1 with abrasive coated surfaces 2 are mounted on shaft 3 driven by an electrical motor 4. The disks 1 made of a metal stamping formed to present a uniform surface of rotation to the edge facet 7 of a knife 5 being shaped by contact with the abrasive surface 2 are mounted on hubs 6 which are driven by shaft 3. The hubs 6 each have a central cylindrical bore hole that is sufficiently larger than the diameter of the shaft 3 to allow the mounted disk 1 to be physically displaced when the knife edge facet 7 contacts the abrasive surface 2 of the disk. A compression spring 8 mounted between the disks 1 forces the disks to return to a rest position that is precisely established by drive pins 9 that are secured to rotate with shaft 3 and of a diameter that fits with clearance in the slot 10 of hubs 6. The terminus of the slots 10 in the hubs establish precisely the rest position of the hubs 6 when the force of spring 8 presses the hubs 6 into physical contact with the drive pins 9. When the facet 7 of a knife edge is pressed with force against the abrasive surface 2, the disk and its hub are displaced from the rest position by that force, equal to the spring force. In that manner the magnitude of the sharpening force can be controlled and limited by the spring force but that force will be equal to the spring force only if there is no friction between the cylindrical bore hole thru the hub 6 and the circumference of the shaft 3 on which it is driven. Any friction between the sliding hub and the shaft will increase the force on the edge facet as it is being sharpened.

This mounting and drive mechanism as described above and shown in FIG. 4 operates stabily with spring forces on the order of 0.2 lb. or greater. However, sharpening forces of this level create excessively large burrs even with ultra fine abrasive grits. Repeated attempts to reduce the burr by using springs of lower force initiated mechanical vibrations of the abrasive surface sufficient in magnitude to cause the sharpening disk to bounce into intermittent contact with the knife edge and the resulting impact of the abrasive surface with the edge facet damaged the ultra fine knife edge sufficiently that further reductions in spring tension becomes counter productive. It proved exceedingly difficult to establish the cause of these destructive vibrations with spring forces below 0.2 pound. These were found to be due to a number of factors and subtle interaction of these same variables.

Figure 1:
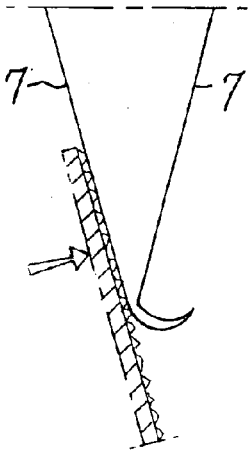
Fig. 1 (Prior Art)
FIG. 1 shows the facet of a blade sharpened by prior art techniques.
Figure 2:
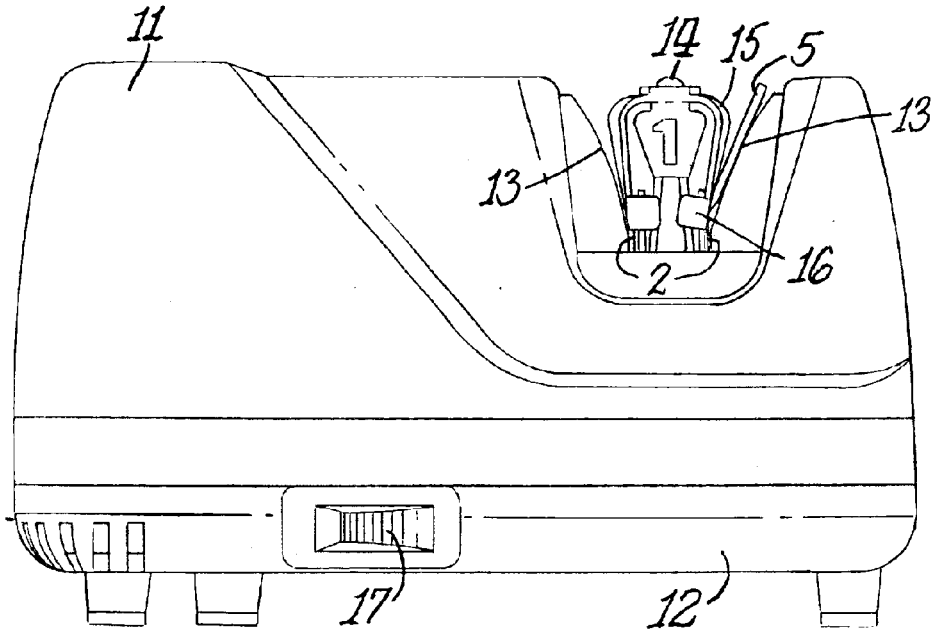
FIG. 2 is a side elevational view of a sharpening device showing a spring mounted in the sharpening stage in accordance with this invention.
Figure 3:
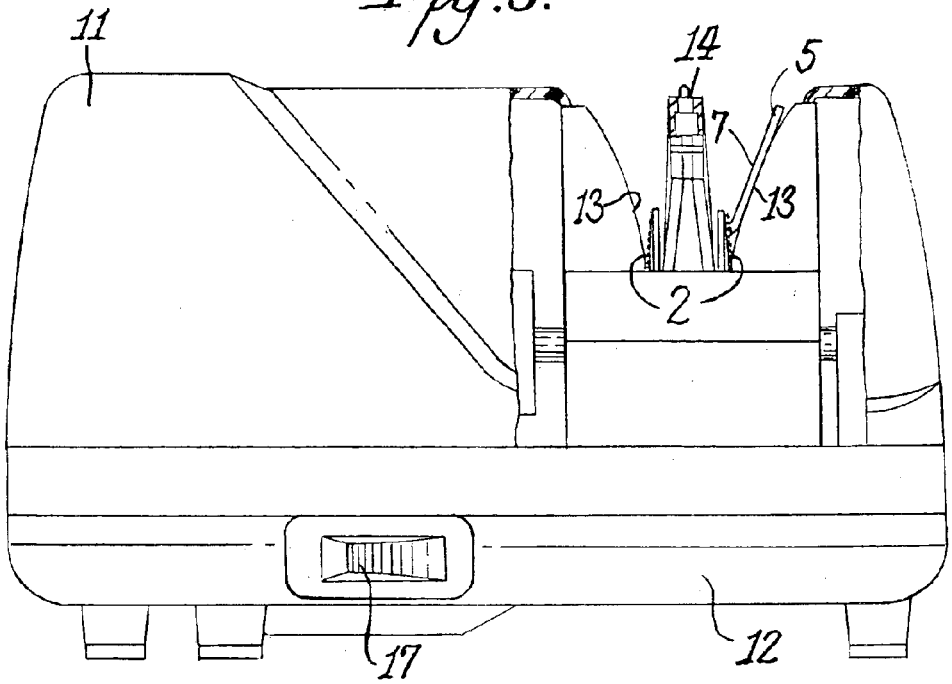
FIG. 3 is a side elevational view of the sharpening device of FIG. 2 with a protective cover.
Figure 5:
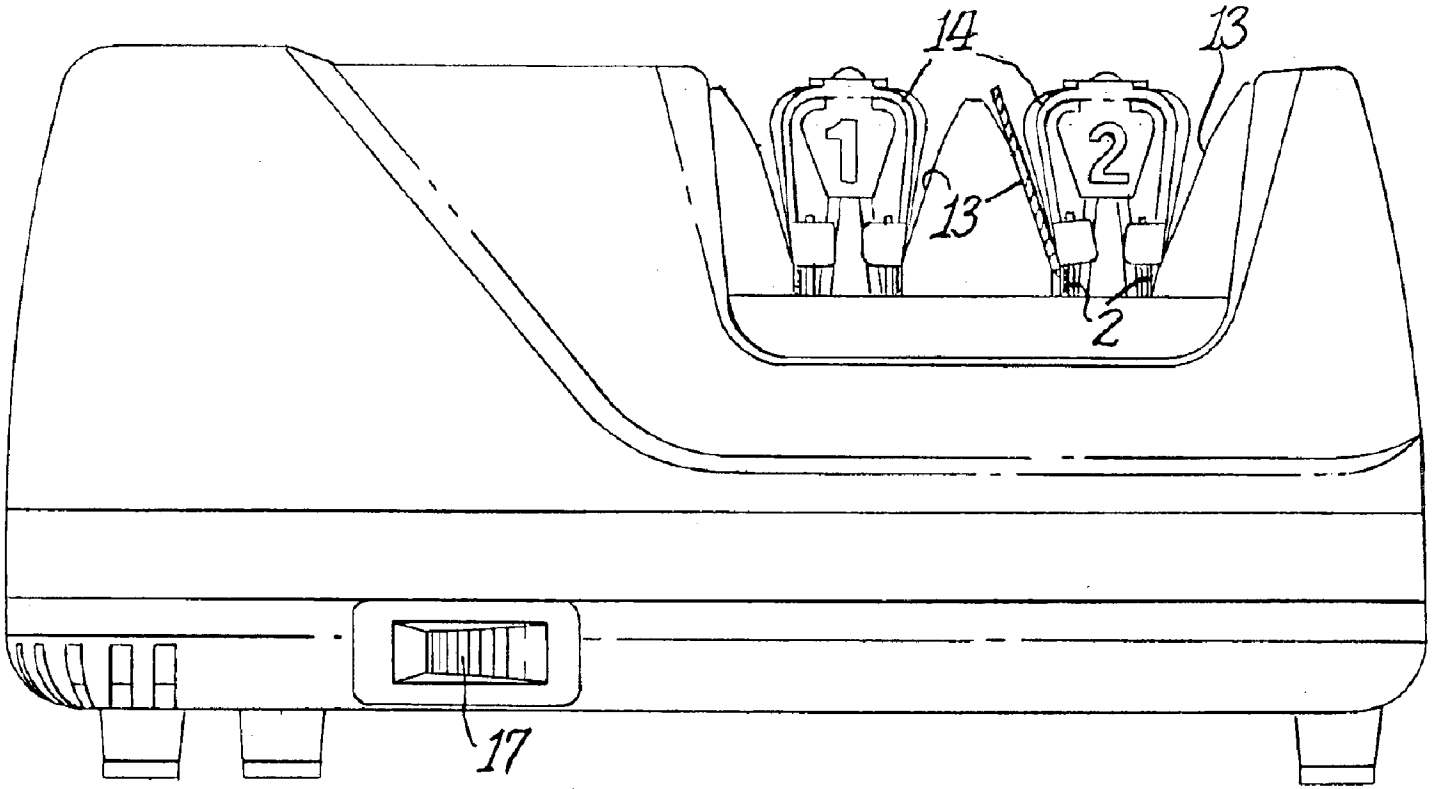
FIG. 5 is a view similar to FIG. 2 of a further multi-stage sharpening device in accordance with this invention.
Figure 6:
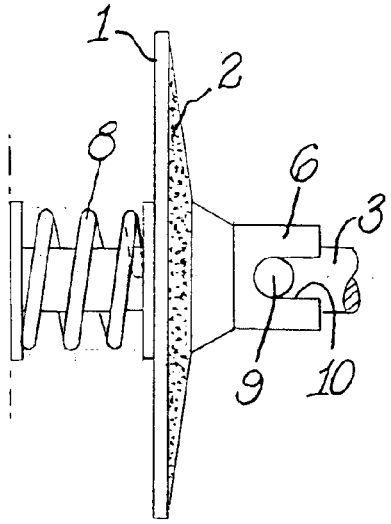
FIGS. 6–7 are side and front elevational views of a rotating disk and its associated structure in accordance with this invention.
Figure 7:
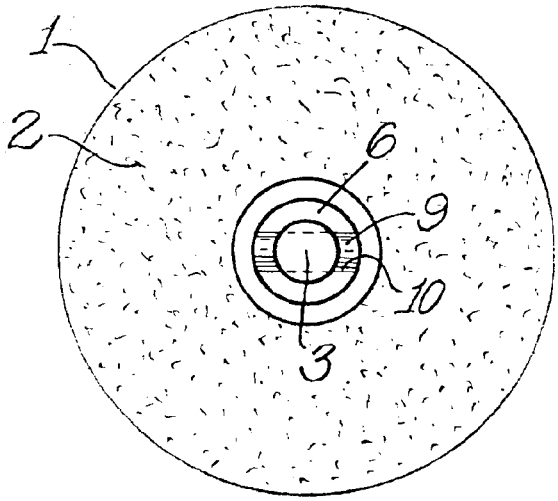

The sharpener of FIG. 4 is shown again in FIG. 3 but with a protective cover 11 in place over the supporting base 12 and with electrical switch 17. The knife 5 is shown in alignment with guide surface 13 and its facet 7 in contact with the rotating abrasive coated surface 2. A plastic support post 14 serves to support flexible plastic spring 15 of FIG. 2 which has arms 16 that extend down and beside guide surface 13. The plastic spring arms 16 contact and press the knife 5 as it is inserted against the knife guide surface 13. Thus the knife 5 is held at the correct angle and position so that its edge facet will be pressed into optimal contact with the rotating abrasive surface 2, As shown in FIGS. 2 thru 4 there is only one pair of disks, however, more disks and sharpening stages can be added as in FIG. 5 on a single shaft. This arrangement has the distinct advantage that a heavier spring can be used in the first stage (Stage 1) and an ultra light spring used in the second stage (Stage 2). Normally one sharpens a first edge facet in the first slot of the first stage of FIG. 5 and then the knife is moved to the second slot to sharpen the second knife facet. The first stage (Stage 1) is added to obtain far more aggressive presharpening to be followed by a final sharpening and edge finishing stage (Stage 2) with the ultra final grit and with ultra low spring force as described herein.

FIGS. 6, 7, 8 and 9 show different views and in greater detail the construction of the rotating disk 1, its hub 6, the drive pin 9, and the slot 10 in the supporting hub 6.

Referring to FIG. 4, the hub 6 made for example from plastic, is caused to rotate with shaft 3 by virtue of the drive pin 9 preferably cylindrical in shape which is attached thru the shaft 3 and sized to fit within slot 10 molded into the plastic hub. As the disk 2 is displaced from its rest position by a blade being sharpened, the disk on its hub moves slidingly and parallel to the axis of the motor shaft away from the blade and the drive pin slides within the elongated hub slot 10 while remaining constrained in that slot. The diameter of drive pin 9 must be less than the width of the hub slot 10 in order that it not restrain the displacement of the hub and its supporting disk. It is important that the force to displace the disk be substantially only the ultra low force of the restraining spring action provided by spring 8.

Figure 8:
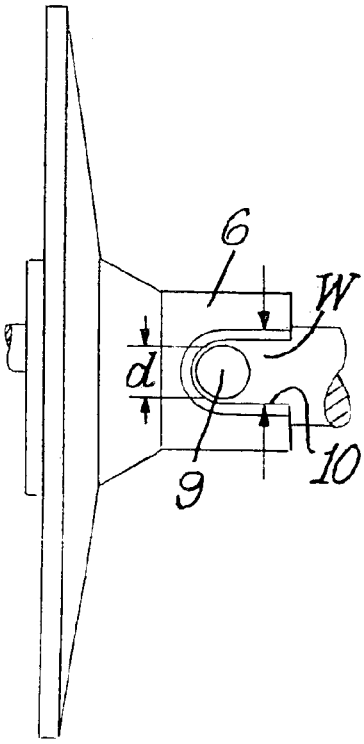
FIGS. 8–9 are views similar to FIGS. 6–7 of modified structure in accordance with this invention.

While the drive pin must be free to move within slot 10 it was discovered that objectionable vibrations of the hub and disk surface will occur if the width of the hub slot W is much greater than the diameter d of the drive pin 9, of FIG. 8. These vibrations initiate when low force springs are used as the knife is withdrawn and can be sufficiently severe that the disk will not return to its rest position, instead it will continue to resonate as the drive pin 9 impacts alternate sides of the hub slot 10. Because the disk does not properly return to its rest position, the sharpening action is severely compromised.

Figure 9:
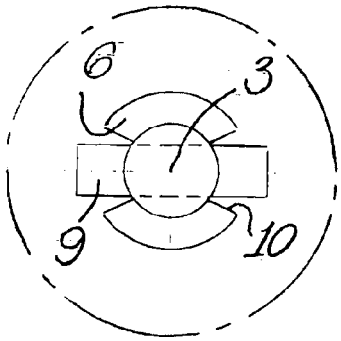

It was found that the vibration and adverse resonance of the hub and disk could be eliminated by limiting width W (FIG. 8) of the slot to not more than 0.055 inch greater than the diameter d of the drive pin. This eliminates the opportunity for the pin to gain excessive angular velocity as it is accelerated by minor variations in motor speed and its force of impact on the wall of the hub slot was found to be insufficient to create a significant resonance of the hub. To reduce this resonance further it proved helpful to taper the walls of the drive slot as shown in FIG. 9 so that the width of the slot at its bottom (adjacent shaft) is smaller than at the top of that slot. In this way the drive pin would strike the slot wall of the hub 6 only at the bottom of the slot, immediately adjacent to the shaft 3 where resonances could be damped promptly. It proved important to insure that the impact point of the drive pin 9 against the wall of the slot was as close as possible to the bottom of the slot wall—adjacent to the shaft 3.

Because of the exceedingly light force spring used to restore the hub and disk to their rest position there is a tendency of the drive pin as it returns to its rest position to also impact the bottom of the slot with sufficient momentum to set up a resonance in the direction of the axis of the shaft and causes the hub/disk combination to vibrate in and out of the rest position—again interfering with the sharpening action. It was discovered that the magnitude of these vibrations could be reduced by placing filets in the inside corners of the slot curved to match the radius of the drive pin as shown in FIG. 8. This caused the pin to make random contact with a matching contour rather than at a single point along its circumference which helped to break up the tendency to resonate.

Some of the mechanical resonances that gave rise to the bouncing effect of the disks described above have their origin in the non-uniform angular speed of drive motors and the small but excessive instantaneous changes in the torque and speed of the motor as the magnetic poles of the motor armature cross the fixed poles of the motor. This is particularly a problem with inexpensive two pole shaded pole motors widely used in sharpening devices.

These resonances occur also in part because of eccentricities of sharpening disks coupled with any looseness of the displaceable disks on the drive shaft. The disks must be free to move (slide) along the shaft in response when the edge of the knife contacts the abrasive surface of the sharpening disk. The sharpening disk or disks are held in a rest position on the shaft by the force of the restraining spring which pushes the disk to its rest position. The relationship of the locations of the stop-pin on the shaft, the abrasive surface on the disk and the knife guide must be extremely precise in order that when the blade to be sharpened is placed on the knife guide and slid into contact with an appropriate area on the abrasive surface of the disk the rotating disk will be displaced along the motor shaft during the actual sharpening process. This insures that the disk is always displaced somewhat during the sharpening process and the sharpening force on the facet of the blade edge can be controlled primarily by the force of the compression spring.

Because the disk assembly (the disk held by its plastic hub) must slide (be displaced) freely on the motor shaft against the spring force when contacted by the knife edge, there must be sufficient clearance between the cylindrical bore of the hub and the shaft surface to avoid frictional effects that are much greater than the restoring force of the spring. Excessive friction will cause the hub to bend or freeze on the shaft and create excessive forces on the edge of the knife being sharpened and as a result gauge the knife edge, thus destroying the sharp edge being created. When a low force spring, below 0.2 pound, is used in order that the knife edge be abraded very gently, the frictional forces between the hub and shaft must be exceedingly small. However, if the bore size of the hub is increased sufficiently in order to reduce friction to that level that the frictional effects do not interfere with the spring action, mechanical resonances can be created that vibrate the abrading surface and lightly "hammer" the edge being sharpened. The quality and fineness of the edge is adversely deteriorated by the physical resonances that can occur. The optimum clearance between a shaft 3 of 0.2496 inch diameter and the cylindrical bore of the hub 6 was found to be about 0.0009 inch.

The hammering effect that can occur due to these resonances is further exacerbated by the disk runout—namely any imperfections in the symmetry of the disk's abrasive surface relative to its axis of rotation. If the runout is excessive the resonance will be enhanced and the hammering effect can be sufficient to prevent the creation of exceedingly sharp knife edges by the disk sharpening system.

A convenient design for the abrasive disk is a thin adhered layer of abrasive particles, preferably diamonds, on a rigid shaped substrate such as a symmetrical metal disk for example in the shape of a truncated cone. With this design runout of the abrasive surface of the disks can be diminished by "wearing in" the surface abrasive the abrasive surface when the size of the abrasive grit or thickness of abrasive layer is significantly larger than the runout of the metal substrate. In effect initial wear of the abrasive on a disk surface with runout is largely at high spots on the disk surface and by "wearing in" any high spots are lowered which in turn improves the apparent runout of the disk. With a single layer of fine grit sized less than the magnitude of run-out, the amount of "wearing in" of the surface is limited. Hence when using ultra fine grits there is a greater requirement that the initial runout of the disk be exceedingly small. For example, runout of the symmetrically shaped surface in a direction normal to the surface about its axis of rotation is less than ± .006 inches.

Efforts to create stable—non-resonating abrasive disk systems with grit sizes less than 0.002 inch diameter with spring forces less than 0.2 pound and as low as 0.01 pound (0.16 ounce) restoring the disk to its rest positions, driven by conventional low cost motors at about 3000 to 3600 RPM were ineffective if the shaft of the driving motor or the shaft on which the sharpening disks were mounted had an eccentric motion, that is had a wobble or lateral motion of its axis greater than±± 0.006 inch. Such eccentric motion aggravated the resonance especially if the clearance between the drive shaft (0.2496 inch diameter) and the hole in the plastic hub of the disk assembly exceeded 0.0009 inch. The resonance became unacceptable with clearances greater than 0.002 inch if one wished to create exceedingly sharp knives. It was possible in spite of the interaction of such small mechanical imperfections and the difficulty of isolating the cause of damaging resonances to establish the acceptable limits for each type of imperfection as described above.

What is claimed is:

1. In a knife sharpener having a finishing stage for sharpening the edge of a metal knife with one or more facets adjacent the edge, said finishing stage comprising a motor driven shaft, at least one slidingly mounted sharpening disk assembly, said assembly comprising a hub structure having a central bore hole through which said shaft extends for rotating said disk assembly, said hub structure supporting a symmetrically shaped rotating abrasive surface containing an ultrafine abrasive material, a knife guide disposed near said surface to align the facet into contact with said surface, and resilient structure pressing against said surface in a direction toward said guide with a force of less than 0.2 lb. by a spring action to maintain sustained rotating abrading contact with the facet and to minimize the presence of any burr being formed on the facet.

2. A sharpener according to claim 1 where said symmetrically shaped surface is a shaped metal disk coated with said ultra fine abrasive material.

3. A sharpener according to claim 1 where said ultra fine abrasive material is of grit size less than 0.0016 inch diameter.

4. A sharpener according to claim 1 where said ultra fine abrasive material is diamonds.

5. A sharpener according to claim 1 where said bore hole of said hub structure is nominally cylindrical and of a diameter not more than 0.002 inch larger than the diameter of said driven shaft.

6. A sharpener according to claim 1 where runout of said symmetrically shaped surface in a direction normal to said surface about its axis of rotation is less than ±0.006 inches.

7. A sharpener according to claim 1 where a drive pin attached to said shaft loosely engages in an elongated open ended slot in said supporting hub structure to cause said hub structure to rotate with said shaft and allow said hub structure with said symmetrically shaped abrasive surface to move slidingly along the shaft in opposition to said spring action when the knife facet makes contact with said surface.

8. A sharpener according to claim 7 where said drive pin is cylindrical with a diameter not less than 0.055 inches smaller than the width of said elongated open ended slot measured nominally at the bottom of said slot.

9. A sharpener according to claim 8 where the width of said slot is less at the bottom of said slot adjacent to said shaft that the width of said slot at the top of said slot.

10. A sharpener according to claim 8 where the interior corners of said slot are shaped with a circular shaped filet nominally of the same radii as said drive pin.

11. A sharpener according to claim 1 where said ultra fine abrasive material is of a grit size less than 0.002 inch diameter.

12. A sharpener for the edge of a metal knife with one or more facets adjacent the edge comprising a motor driven shaft with one or more slidingly mounted sharpening disk assemblies, each of said assemblies comprising a supporting hub structure mounted by its central bore hole on said shaft and supporting a symmetrically shaped rotating abrasive surface containing an ultra fine abrasive material which surface is pressed with a force of less than 0.2 lb. by a spring action to make sustained rotating abrading contact with a facet of the knife positioned by a knife guide to align the facet into contact with said surface containing said abrasive material, a drive pin attached to said shaft loosely engaged in an open ended slot in said supporting hub structure to cause said hub structure to rotate with said shaft, a clearance between said bore hole and said shaft to allow said hub structure with said symmetrically shaped abrasive surface to move slidingly along said shaft in opposition to said spring action when the knife facet makes contact with said surface, said clearance being sufficiently small to minimize mechanical resonances and being sufficiently large to minimize frictional effects as said hub structure slides on said shaft, said slot having a top at its open end and a bottom at its closed end, said bottom being of generally the same width as the width of said drive pin, and said symmetrically shaped surface having sufficiently small runout in a direction normal to said surface about its axis of rotation to minimize resonance.

13. A sharpener according to claim 12 where said symmetrically shaped surface is a shaped metal disk coated with said ultra fine abrasive material.

14. A sharpener according to claim 12 where said ultra fine abrasive material is of grit size less than 0.0016 inch diameter.

15. A sharpener according to claim 12 where said ultra fine abrasive material is diamonds.

16. A sharpener according to claim 12 where said bore hole of said hub structure is nominally cylindrical and of a diameter not more than 0.002 inch larger than the diameter of said driven shaft.

17. A sharpener according to claim 12 where said runout is less than ±0.006 inches.

18. A sharpener according to claim 12 where said drive pin is cylindrical with a diameter not less than 0.055 inches smaller than the width of said elongated open ended slot measured nominally at said bottom of said slot.

19. A sharpener according to claim 12 where the width of said slot is less at said bottom of said slot adjacent to said shaft that the width of said slot at said top of said slot.

20. A sharpener according to claim 19 where the interior corners of said slot are shaped with a circular shaped filet nominally of the same radii as said drive pin.

21. A sharpener according to claim 19 where said slot tapers inwardly from said top to said bottom.

22. A sharpener according to claim 12 where said ultra fine abrasive material is of a grit size less than 0.002 inch diameter.

* * * * *